United States Patent [19]

Thompson

[11] 4,437,496

[45] Mar. 20, 1984

[54] PAPERMAKERS FABRICS HAVING EQUALIZED WARP SEW-UP

[75] Inventor: Charles E. Thompson, Raleigh, N.C.

[73] Assignee: Huyck Corporation, Wake Forest, N.C.

[21] Appl. No.: 359,095

[22] Filed: Mar. 17, 1982

[51] Int. Cl.[3] ..... D03D 15/00; D21F 1/10

[52] U.S. Cl. ..... 139/383 A; 139/425 A; 162/DIG. 1

[58] Field of Search ..... 139/383 A, 425 A, 383 R, 139/416; 162/DIG. 1, 348, 358; 245/10; 210/499, 507

[56] References Cited

U.S. PATENT DOCUMENTS

| | | | |
|---|---|---|---|
| 1,733,116 | 10/1929 | Coups | 139/425 A |
| 2,041,137 | 5/1936 | Koester | 139/383 A |
| 4,161,195 | 7/1979 | Khan | 139/383 A |
| 4,231,401 | 11/1980 | Matuska | 139/383 A |
| 4,281,688 | 8/1981 | Kelly et al. | 139/383 A |

FOREIGN PATENT DOCUMENTS

| | | | |
|---|---|---|---|
| 836838 | 3/1970 | Canada . | |
| 1350537 | 12/1963 | France | 139/383 R |
| 688 | of 1869 | United Kingdom . | |

*Primary Examiner*—James Kee Chi

*Attorney, Agent, or Firm*—Kenway & Jenney

[57] ABSTRACT

The present invention is directed to the problem which occurs when papermakers' fabrics are woven in a pattern in which the various warp of the pattern require different warp yarn lengths, i.e. unequal sew-up. The invention solves the problem by providing a monoplanar papermakers' fabric formed of warp and weft yarns interwoven in a repeating sequence of first and second adjacent patterns which alternate along the warp. The warp of the second weave pattern have a sequence of numbers of interlacings which is the reverse of the sequence for the first weave pattern so that the total number of interlacings in the combined first and second weave patterns is equal for all warp yarns.

5 Claims, 2 Drawing Figures

REVERSE BROKEN TWILL

PAPERMAKERS FABRICS HAVING EQUALIZED WARP SEW-UP

BACKGROUND OF THE INVENTION

1. Field of the Invention

This invention relates to woven papermakers' fabrics and, particularly, to woven fabrics for the wet end of the paper machine.

2. Description of the Prior Art

In the course of the developent of the technology relating to papermakers' fabrics twill weave patterns came to be preferred to a plain weave because the twill patterns by virtue of their surface floats provided superior sheet support and by virtue of less yarn interlacing through the center of the fabric afforded a more crowded or tighter weave structure and, hence, better fiber retention. However, the conventional twill weave patterns proved unacceptable because the fabric lacked the requisite structural stability. This lack of structural stability is due to the fact that adjacent yarns are sufficiently locked in place by crimping to retain their intended position within the weave pattern and tend to be shoved together in service, a fabric defect sometimes referred to in the art as "shoviness."

The so-called "reverse broken twill" (RBT) weave patterns have gained wide acceptance in the art as a compromise between the superior sheet support and fabric dewatering afforded by a twill pattern and the fabric stability afforded by a plain weave. FIG. 1 of the drawings illustrates a conventional reverse broken twill woven on 4 harnesses (an example of a four end repeat). Viewing that weave pattern, it can be appreciated that it affords a plurality of surface two-floats in combination with the interlocking afforded by warp yarns 2 and 4 woven as in a plain weave. However, the reverse broken twill of FIG. 1 presents the art with another problem which is referred to herein as "unequal warp sew-up." Bearing in mind the maxim the the shortest distance between two points is a straight line, it can be seen that warps 2 and 4 in the reverse broken twill pattern of FIG. 1 require a greater length of yarn in that pattern than do yarns 1 and 3. That is because, in addition to a yarn length corresponding to the width of the fabric, each warp requires an additional increment of yarn length for each passage through the central plane of the fabric. Warp yarns 1 and 3 pass traverse the thickness at the fabric twice for each pattern repeat and thus are characterized as having two interlacings per pattern repeat. Yarns 2 and 4 pass traverse the thickness of the fabric four times in each pattern and therefore are characterized as having four interlacings per repeat.

The inequality in the amount of sew-up or yarn lengths required for the various warp yarns of a pattern such as is shown in FIG. 1 do not present a significant problem for fabrics woven from relatively elastic mateials such as wool and other natural fibers. Likewise, in the use of twisted spun yarns spun from natural fibers, the so-called "plied" yarn, the yarns tend to compensate for unequal sew-up by yielding a degree of twist and thereby lengthening to some extent. However, no such "natural" compensation is possible with the use of monofilament or continuous filament/multifilament yarns which has come into vogue in recent years. When monofilament warp yarns are woven on a conventional loom in a pattern repeat as is shown in FIG. 1, there is no compensation for the difference in sew-up as between yarns 1 and 3 and yarns 2 and 4; rather, the problem is cumulative across the width of the fabric. In other words, as the weave pattern is repeated across the width of the (endless woven) fabric, warp yarns 1 and 3 accumulate slack, eventually to the point where yarns 1 and 3 can no longer be "shed", i.e. lifted above the pick. In addition to the problem presented to loom operatio, unequal sewup also causes defects in the fabric product. With unequal sewup, the tighter warp yarns, yarns 2 and 4 of the pattern of FIG. 1, tend to be straighter and locate more in the center of the fabric. Likewise, the more slack yarns, yarns 1 and 3 in the pattern of FIG. 1, tend to undulate in a loose crimp from surface to surface, with the result that the surface floats of yarns 1 and 3 will have a greater amplitude than the surface knuckles of yarns 2 and 4. Accordingly, unequal warp sew-up will result in the wearing of only ½ of the warp yarns on the machine side of the fabric and a deterioration of sheet support at the forming surface of the fabric.

One possible solution to the aforementioned problem of unequal warp sew-up would be to provide a loom with two warp-beam let-offs. However, such a solution to the problem represents an additional capital investment and complications in the loom operation, which factors make such a solution unattractive to many in the industry.

Thus, it is an object of the present invention to provide a papermakers' fabric with desirable sheet support, fiber retention and wear characteristics.

It is another object of the present invention to provide a fabric having such characteristics woven in a pattern with equal sew-up in the warp.

These and other objects, features and scope of applicability of the present invention will become apparent to those skilled in the art from a reading of the ensuing description in conjunction with the drawings.

SUMMARY OF THE INVENTION

The present invention provides a solution to the aforementioned problem of "unequal sew-up" by providing a monoplanar papermakers' fabric formed of warp and weft yarns interwoven in a repeating sequence of first and second adjacent weave patterns, which weave patterns alternate in the direction of the warp yarns. Both of the first and second weave patterns are characterized by unequal warp sew-up. However, the second weave pattern is woven with a sequence of numbers of warp interlacings which is the reverse of the warp interlacing sequence in the first weave pattern, with the result that in the combined first and second weave patterns all warp yarns have the same number of interlacings and the same degree of sew-up.

Thus, the term"sew-up", as used herein, has reference to the lengths of the various warp yarns of a given weave pattern. The terminology "unequal sew-up" refers to the fact that, in a given weave pattern, different lengths of yarns are required for the warp due to a difference in the degree of interlacing for the different warp.

The term "monoplanar", as used herein, has reference to a fabric composed of a single series of weft yarns interwoven with a single series of warp yarns. Thus the overall thickness of the fabric will vary between (1) the sum of the weft and warp diameters and (2) the sum of the weft diameter plus twice the warp diameter, depending on the straightness of the weft. The term "monoplanar" is intended to include fabrics modified by incorporation of "floater" yarns in accordance with co-pending U.S. application Ser. No. 341,744 entitled "PAPERMAKERS' FABRIC", filed Jan. 22, 1982.

DESCRIPTION OF THE PREFERRED EMBODIMENTS

Figure 1:
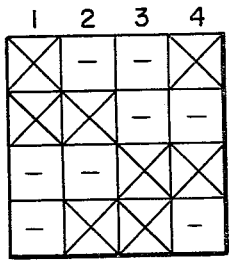
FIG. 1. (PRIOR ART)
FIG. 1 is a prior art reverse broken twill pattern.
Figure 2:
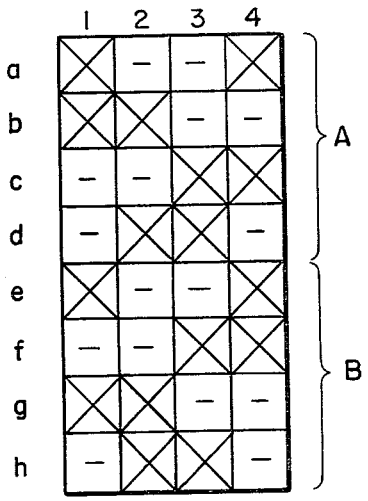
FIG. 2 is an adaption of a reverse broken twill pattern woven on 4 harnesses.

FIG. 2 illustrates a preferred embodiment of the present invention which is an adaption of a reverse broken twill weave pattern, woven on 4 harnesses. The present invention also contemplates similar adaptations of reverse broken twill patterns woven on 5 harnesses, etc. and is applicable to any weave pattern characterized by unequal warp sew-up. A reverse broken twill pattern is preferred in the present invention because it is a balanced pattern, i.e. every weft yarn has an equal number of warps running thereover and thereunder, and is therefore free from edge curl. It is also preferred for the reasons previously mentioned in connection with the prior art reverse broken twill pattern of FIG. 1, e.g. its desirable stability due to the presence of a plain weave in every other warp yarn.

In the embodiment of FIG. 2 pattern A is identical to the prior art reverse broken twill pattern of FIG. 1. It is woven in accordance with a first set of shedding and picking instructions wherein warp 1 is raised for picks A and B and lowered for picks C and D. Warp 2 is lowered for pick A, raised for pick B, lowered for pick C and raised for pick D. Warp 3 is lowered for picks A and B and raised for picks C and D. The shedding instructions for warp 4 in pattern A raise warp 4 for pick A, lower it for pick B, raise it for pick C and lower it for pick D. In forming the next structural unit or weave pattern of the fabric (across the width of the belt in an endless weave) the interlacing sequence for the various warps is reversed. Thus the shedding instructions for warp 4 in pattern A become the shedding instructions for warp 1 in pattern B, the shedding instructions for warp 3 in pattern A become the shedding instructions for warp 2 in FIG. B, the shedding instructions for warp 2 in pattern A become the shedding instructions for warp 3 in pattern B and the shedding instructions for warp 1 in pattern A become the shedding instructions for warp 4 in pattern B. If one defines one interlacing as a single passage of a warp from its highest point to its lowest point in the fabric cross section, pattern A can be characterized as having a sequence of numbers of interlacings of 2, 4, 2 and 4, for warp 1, 2, 3 and 4, respectively. In pattern B that sequence is reversed so that the interlacing numbers are reversed, i.e. 4, 2, 4 and 2, respectively, for warp 1, 2, 3 and 4. Thus, across combined patterns A and B each warp has 6 interlacings.

The warp and weft yarns used in the present invention are preferably formed of synthetic materials conventionally used in such fabrics such as polyamides, such as nylon, polyesters, such as dacron and acrylic fibers such as ORLON, DYNEL and ACRILAN or copolymers such as SARAN. Monofilament yarns are preferred, especially for the warp of the fabrics of the present invention. These monofilaments are preferably of a polyester such as KEVLAR or KEVLAR 29, trademarks of E.I. DuPont de Nemours & Company for synthetic fibers which comprise poly (paraphenylene terephthalamide).

Fabrics of the present invention may be woven flat or endless. In accordance with conventional wisdom, the crossmachine direction yarns should constitute the wear surface on the machine side of the fabric. Leaving the machine direction yarns, which are under considerably greater tension, relatively free from wear. Accordingly, when a papermakers' fabric is woven as an endless belt in accordance with the present invention the warp constitutes the cross-machine direction yarns and the aforementioned first and second weave patterns alternate across the width of the belt. In such an endless woven belt, the weft will run substantially straight through the central plane of the fabric so that the cross-machine direction yarns (warp) constitute the wear surface at the machine side of the fabric.

The fabrics of the present invention may be modified to advantage by incorporation of floater yarns in accordance with the teachings of applicant's co-pending U.S. application Ser. No. 341,744 entitled "PAPERMAKERS' FABRIC", filed JAN. 22, 1982.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An endless loop monoplanar papermakers' fabric formed of warp and weft yarns interwoven in a repeating sequence of first and second adjacent balanced weave patterns which patterns, alternate in the direction of the warp yarns, wherein said first weave pattern is characterized by the presence of warp yarns having, in a first sequence, differing numbers of interlacings and wherein said second weave pattern is characterized by said warp yarns being woven in a second sequence of numbers of interlacings, said second sequence of numbers of interlacings being the reverse of said first sequence so that the total number of interlacings in the combined first and second weave pattens is equal for all warp yarns.

2. The papermakers' felt of claim 1 wherein said first weave pattern is a reverse broken twill.

3. The papermakers' fabric of claim 1 or 2 wherein said warp yarns are synthetic multifilament or monofilament.

4. The papermakers' fabric of claim 1 or 2 wherein each of said first and second patterns is in a four end repeat.

5. An endless woven fabric belt in accordance with claim 1 wherein said warp yarns are in the cross-machine direction so that said first and second weave patterns alternate across the width of the belt and wherein said weft yarns run substantially straight through a plane defining the center of the fabric thickness so that the cross-machine direction yarns constitute the wear surface of the fabric.

* * * * *